United States Patent [19]

Moore

[11] Patent Number: 4,629,097

[45] Date of Patent: Dec. 16, 1986

[54] SNAP-ACTION ORIFICE SEALING PLUG FOR VISCOUS PRODUCT DISPENSER

[75] Inventor: David G. Moore, Lee's Summit, Mo.

[73] Assignee: Realex Corporation, Kansas City, Mo.

[21] Appl. No.: 704,488

[22] Filed: Feb. 22, 1985

[51] Int. Cl.[4] ..... B67D 5/32; B67D 5/42

[52] U.S. Cl. ..... 222/153; 222/386; 222/387; 222/498; 222/505; 222/260

[58] Field of Search ..... 222/517, 153, 380, 383, 222/384, 385, 386, 387, 389, 511, 320, 321, 340, 207, 209, 212, 498, 505, 556

[56] References Cited

U.S. PATENT DOCUMENTS

| | | | |
|---|---|---|---|
| 1,515,127 | 11/1924 | Levinthal | 222/209 |
| 3,289,877 | 12/1966 | Wolf | 220/339 |
| 4,346,810 | 8/1982 | Kneissl | 215/237 |
| 4,386,714 | 6/1983 | Roberto et al. | 222/517 X |
| 4,442,955 | 4/1984 | Bush | 222/153 |
| 4,506,805 | 4/1985 | Marcon | 222/153 |
| 4,511,068 | 4/1985 | Bossina | 222/257 |

FOREIGN PATENT DOCUMENTS 3104726 8/1982 Fed. Rep. of Germany .

OTHER PUBLICATIONS

U.S. Ser. No. 06/565,540; filed Dec. 27, 1983; Ford et al; Pasty Product Dispenser Having Combination Actuator and Outlet Valve.

*Primary Examiner*—Joseph J. Rolla
*Assistant Examiner*—Jay I. Alexander

[57] ABSTRACT

The depressible actuator of the pump has a closure plug hingedly and integrally attached thereto in association with an integral toggle so that the plug may be snapped between a pair of opposite over-center positions about the hinge point. In one of the positions, the plug may be inserted snuggly into the otherwise open end of the dispensing spout of the pump so as to close and seal the latter, while in the other over-center position the plug is snapped back into a fully clearing relationship with the spout to not only open the latter but also remain out of the path of discharging travel of product emanating from the spout. When the plug is securely received within the spout, it cannot be pulled out merely by depressing the actuator, and thus the actuator becomes effectively locked against depression at that time.

7 Claims, 5 Drawing Figures

SNAP-ACTION ORIFICE SEALING PLUG FOR VISCOUS PRODUCT DISPENSER

TECHNICAL FIELD

This invention relates to the field of pump dispensers, particularly those for viscous products and, more especially, relates to a novel, protective closure arrangement for the discharge spout of such pumps.

BACKGROUND

Prior pending U.S. application Ser. No. 06/565,540; Filed Dec. 27, 1983, in the name of Ford et al., titled "PASTY PRODUCT DISPENSER HAVING COMBINATION ACTUATOR AND OUTLET VALVE", assigned to the assignee of the present invention, discloses and claims a viscous product dispenser having its spout closable by a valve cover or flap integrated into and made a part of the actuator which is depressed for operating the pump. The rigid flap covers and seals off the spout when the actuator is in its standby position and lifts off the spout to uncover the same when the actuator is depressed to its operated position.

Thus, the flap in said prior application is immovable relative to the actuator and is either opened or closed depending solely upon the position of the actuator itself.

There are times, however, when it would be desirable to be able to open the end of the spout without also depressing the actuator. On the other hand, having the valve flap built into the actuator assures that the closure for the spout will not be lost or misplaced since it is always attached to and made a part of the pump itself.

SUMMARY OF THE PRESENT INVENTION

Accordingly, one important object of the present invention is to provide a closure for the spout which is attached to and carried by the actuator so as to always remain associated with the pump and thus avoid misplacement or loss, yet which can be flipped opened or closed in a snap action relative to the actuator by virtue of an integral hinge and toggle associated with the closure and actuator.

Furthermore, an important object of the invention is to provide the toggle action closure with a plug-like configuration so that, when in its closed position, the closure fits down snuggly into the discharge end of the spout and thus securely holds the actuator against unintentional depression in a pumping stroke, forming in this respect a type of releasable lock or latch which doubles also as a spout closure.

DETAILED DESCRIPTION

Figure 1:
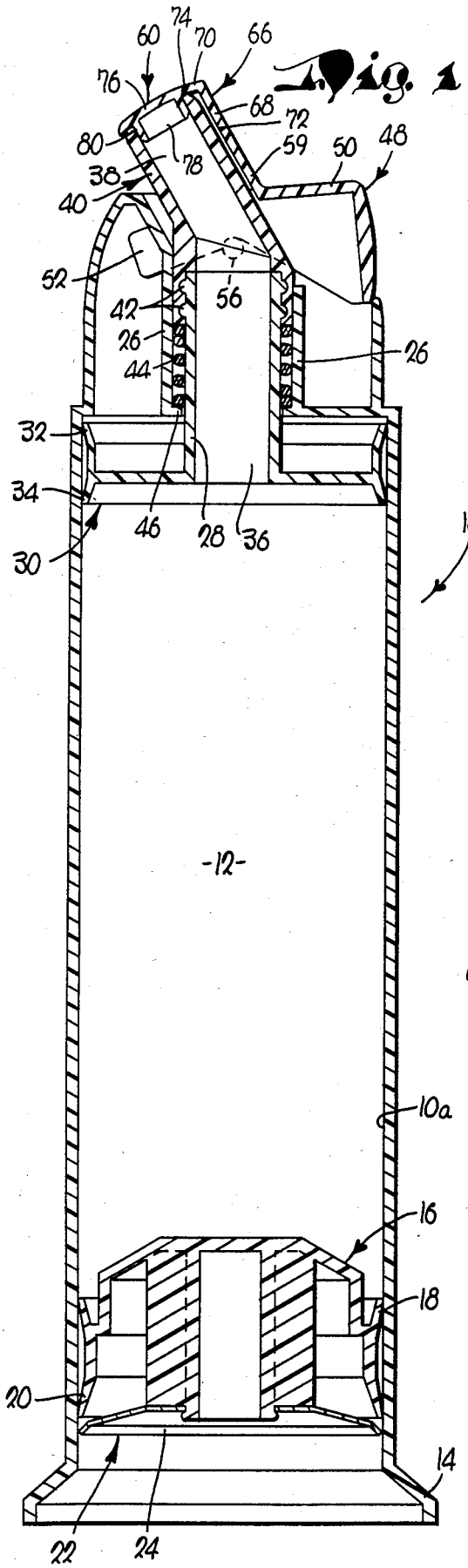
FIG. 1 is a longitudinal, vertical cross-sectional view of a dispenser constructed in accordance with the principles of the present invention showing the actuator in an undepressed condition with the closure plug snapped into the open end of the spout.

The pump of the present invention has a long, tubular, normally upright body 10 provided with an internal pumping chamber 12 within which the product is confined. The lower end of the body 10 has an outwardly flaring skirt 14 which facilitates standing the pump in an upright condition on a supporting surface, and the internal chamber 12 is open to the atmosphere in the area of the skirt 14 except for the presence of a floating take-up piston 16 which moves progressively upwardly through the chamber 12 as the contents thereof become progressively depleted. In this respect, the piston 16 has a radially outermost, upwardly and outwardly projecting peripheral skirt 18 which makes sealing engagement with the interior surface 10*a* of the body 10, as well as with an outermost, downwardly and outwardly extending second peripheral skirt 20 disposed below upper skirt 18 and likewise making sealing contact with the surface 10*a*. This piston 16 is adapted for upward movement only by virtue of one-way, anti-retrograde means 22 in the form of, for example, a downwardly and outwardly flaring thin metal skirt 24 or the like which makes biting engagement with the surface 10*a*. The angle of attack of the metal skirt 24 with the surface 10*a* is such that the skirt 24 will flex downwardly a sufficient extent as to permit upward movement of the piston 16 yet dig into the surface 10*a* with sufficient force when downward pressure is applied to the top of piston 16 so as to prevent downward movement thereof within the body 10.

Adjacent the upper end of the body 10, a centrally disposed, upright sleeve 26 guidably receives the tubular stem 28 of a pumping piston 30, which itself is provided with outermost upper and lower, peripheral sealing skirts 32 and 34 respectively which wipe along the surface 10*a* of body 10 during reciprocation of the piston 30. An internal, upright passage 36 within the stem 28 communicates with a similar passage 38 in a tubular spout 40 slipped down over the upper end of stem 28 and fixedly secured thereto through snap bead connections 42 or the like. Thus, the spout 40 and the piston 30 are adapted for movement as a unit during reciprocation of the piston 30 and, in this respect, a coil spring 44 surrounding the stem 28 is trapped between an inturned portion 46 of the sleeve 26 at its lower end and the overhead proximal end of the spout 40 so as to yieldably bias the piston and spout upwardly and outwardly relative to the body 10 toward the position as illustrated in FIG. 1.

Figure 2:
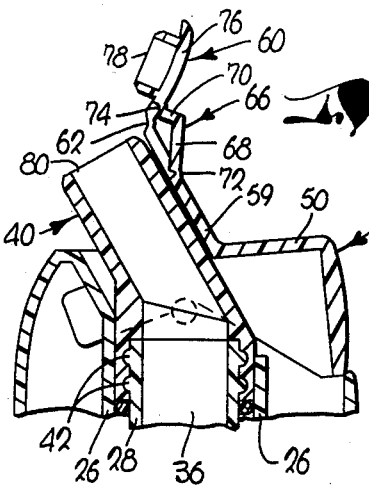
FIG. 2 is a fragmentary, vertical cross-sectional view of the upper end of the pump with the actuator still in its undepressed position but with the closure plug snapped back into its open position.
Figure 3:
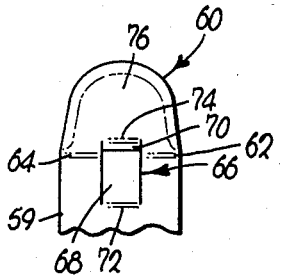
FIG. 3 is an enlarged fragmentary, plan view of the back side of the closure plug showing details of construction of the hinge and toggle associated therewith.
Figure 4:
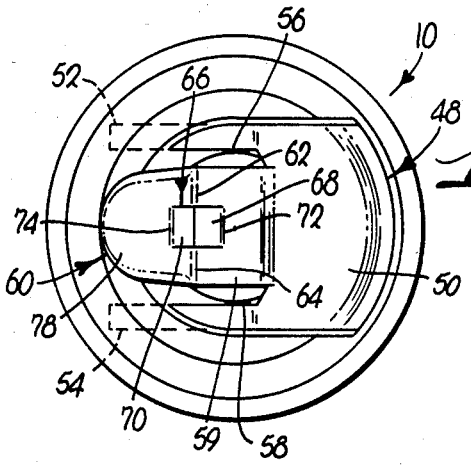
FIG. 4 is a top plan view of the dispensing pump in the condition of FIG. 1.
Figure 5:
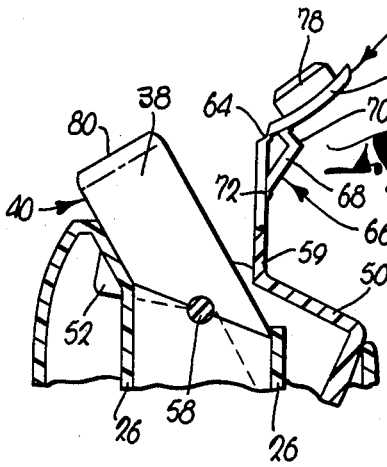
FIG. 5 is a fragmentary vertical cross-sectional view of the pump showing the actuator fully depressed and the closure plug snapped back into its open position.

The piston 30 is operated via an actuator 48 adjacent the upper end of the body 10 and mounted pivotally on the spout 40 for movement between a standby position as illustrated in FIGS. 1 and 2, and a depressed position as illustrated in FIG. 5. A finger engageable portion 50 of the actuator 48 presents a relatively broad surface as illustrated in FIG. 4 for engagement and depression by a user, while a pair of spaced legs 52 and 54 project from the portion 50 and straddle the spout 40 on opposite sides of the latter. Diametrically opposed, outwardly projecting fulcrum pegs 56 and 58 on the exterior of the spout 40 are received in the respective crotches of the legs 52, 54 whereby to rockably support the actuator 48. Th forwardmost ends of the legs 52, 54 are situated beneath overhanging ledge structure (not shown) so that, after the actuator 48 is rocked downwardly about the pegs 56, 58 to a certain extent in a lost motion action, the legs 52, 54 engage the ledge structure for thereafter causing depression of the piston 30 as depression of the actuator 48 continues.

The actuator 48 is also provided with a web portion 59 leading upwardly and forwardly from the finger-enaging portion 50. At the outer end of web portion 59, a closure plug 60 is hingedly attached. Preferably, the actuator 48 and the closure plug 60 comprise integrally molded portions of the same, unitary part, the hinge for the plug 60 comprising a pair of axially aligned, spaced apart lines of weakness 62 and 64. Between the spaced hinge lines 62 and 64 is disposed an inverted generally L-shaped toggle 66 which spans the axis of the hinge lines 62, 64 and has a pair of integrally interconnected, resilient legs 68 and 70. The leg 68 is hingedly joined with the web portion 59 by a hinge line of weakness 72, while the other leg 70 is hingedly joined with the plug 60 by a hinge line of weakness 74. Thus, the toggle 66 is capable of yieldably retaining the plug 60 in either of two opposite, over-center positions illustrated in FIGS. 1 and 2 respectively.

Preferably, the toggle 66 is molded in one piece along with the actuator 48 and the plug 60. In this respect, reference may be had to prior U.S. Pat. No. 3,289,877 issued Dec. 6, 1966, in the name of H. Wolf and titled, "UNITARY HINGE", for a full and complete understanding of one-piece hinges and toggles of this type. The Wolf patent is hereby incorporated by reference into the present specification to the extent necessary to provide a complete understanding of the nature and operation of such single-piece structures.

The plug 60 has a top wall 76 and a depending, concave, cylindrical boss 78 having an external diameter that closely matches the internal diameter of the spout 40 at its outlet orifice 80. Thus, as illustrated in FIG. 1, the boss 78 may be snugly received within the orifice 80 so as to seal the latter against the admittance of ambient air, but only when the actuator 48 is in its undepressed or standby position of FIGS. 1 and 2.

OPERATION

When the dispensing pump is in the condition illustrated in FIG. 1, the actuator 48 is in a standby position with the plug 60 snugly received within the orifice 80 of the spout 40 to close off and seal the latter. Also at this time, it will be noted that because of the geometrical relationship between the plug 60 and the pivot axis for the actuator 48 about the pegs 56, 58, the plug 60 performs a locking function for the actuator 48. In this respect it will be seen that so long as the boss 78 of the plug 60 is well seated within the spout 40, it is virtually impossible for the actuator 48 to be depressed in a clockwise direction about the axis of the fulcrum pegs 56, 58, and thus the dispensing pump is maintained both in a closed or sealed condition and a releasably locked condition against accidental actuation at this time.

In order to operate the pump, it is but necessary to remove the plug 60 from the spout 40 and flip it back over center to an out-of-the-way, open position as illustrated in FIG. 2. The toggle 66, of course, will yieldably retain the spout 60 in such unobstructing location at this time, whereupon the actuator 48 can then be depressed in the manner illustrated in FIG. 5 so as to pump products from the chamber 12.

In this respect, it will be appreciated that as the actuator 48 is fully depressed, the piston 30 is likewise depressed, carrying along with it the spout 40, so that products confined between the lower side of the piston 30 and the upper face of the piston 16 are forced to rise through the passages 36, 38 and out the orifice 80 of the spout 40. As the downward actuating pressure on the actuator 48 is released, the coil spring 44 returns the piston 30 to its original, undepressed position, along with the spout 40 and the actuator 48. The plug 60, however, will remain in its open position as illustrated in FIG. 2, until such time as it is manually flipped over-center against the yieldable resistance of the toggle 66 and inserted into the spout 40.

It will be appreciated that depending upon the viscosity of the product being discharged, a check valve may or may not be necessary within the passageway defined by the passages 36, 38 in order to cause the take-up piston 16 to rise in chamber 12 following release of the depressed actuator 48. In this respect, if the product is highly viscous so as to resist being sucked back reversely through the spout 40 when the latter and the piston 30 rise following a depression stroke, then no check valve will be necessary. However, if the viscosity of the product is too low for the product to serve as its own check valve, then a suitable flapper valve or ball check valve should be inserted so as to cause the negative pressure created within the partially evacuated product chamber 12, coupled with atmospheric pressure on the underside of piston 16, to draw the piston 16 upwardly within the body 10 by an amount which corresponds to and compensates for the volume of dispensed product during the despensing stroke of the actuator 48.

It will be appreciated to those skilled in the art that most of the components of the dispenser as described above and illustrated in the accompanying drawing can most conveniently be molded from a suitable synthetic resinous material.

I claim:

1. In a dispensing pump having a discharge spout and a movable actuator adjacent the spout for operating the pump, the improvement comprising:

a closure for the end of said spout hingedly attached to said actuator for movement relative to the actuator between a closed position for closing the spout and an open position for opening the spout; and toggle means operably coupled with said closure and the actuator for yieldably holding the closure in either of said selected positions, said closure including a plug configured to be matingly received within the spout when the closure is in said closed position thereof.

2. In a dispensing pump having a discharge spout and a movable actuator adjacent the spout for operating the pump, the improvement comprising:

a closure for the end of said spout hingedly attached to said actuator for movement relative to the actuator between a closed position for closing the spout and an open position for opening the spout; and toggle means operably coupled with said closure and the actuator for yieldably holding the closure in either of said selected positions, said closure and said toggle means being integrally formed with the actuator, said closure including a plug configured to be matingly received within the spout when the closure is in said closed position thereof.

3. In a dispensing pump as claimed in claim 2, wherein said toggle means comprises a resilient, generally inverted L-shaped member spanning the hinge between the closure and the actuator and having a pair of resiliently interconnected legs, said member having one leg thereof hingedly joined with the closure and the other leg thereof hingedly joined with the actuator.

4. In a dispensing pump as claimed in claim 2, wherein said spout is mounted for reciprocation during each dispensing operation of the actuator, said actuator being coupled with said spout in a manner to reciprocate the spout during operation of the actuator.

5. In a dispensing pump having a discharge spout and a movable actuator adjacent the spout for operating the pump, the improvement comprising:

a closure for the end of the spout secured to the actuator but movable relative to the latter between an open position for opening the spout and a closed position for closing the spout when the actuator is in a standby position, said closure being disposed when in said closed position to engage the spout in a manner that prevents operation of the actuator, thereby releasably locking the same in said standby position, said closure comprising a plug insertable into the spout.

6. In a dispensing pump as claimed in claim 5, wherein said plug is hingedly attached to the actuator for swinging movement between said open and closed positions.

7. In a dispensing pump as claimed in claim 6, wherein said plug is provided with a toggle between the same and the actuator for yieldably retaining the plug in either of said open and closed positions thereof.

* * * * *